United States Patent [19]

Frankland et al.

[11] 4,182,540

[45] Jan. 8, 1980

[54] METHOD OF SEALING GAS DISCHARGE DISPLAYS

[75] Inventors: Roger A. Frankland, Scottsdale; Henry E. Franklin, Tempe, both of Ariz.

[73] Assignee: Beckman Instruments, Inc., Fullerton, Calif.

[21] Appl. No.: 863,277

[22] Filed: Dec. 22, 1977

[51] Int. Cl.[2] ..... H01J 9/38; H01J 9/40

[52] U.S. Cl. ..... 316/19; 316/20; 316/24

[58] Field of Search ..... 316/19, 18, 20, 24

[56] References Cited

U.S. PATENT DOCUMENTS

| | | | |
|---|---|---|---|
| 3,628,846 | 12/1971 | Cortorillo | 316/18 |
| 3,778,126 | 12/1973 | Wilson | 316/20 |
| 3,914,000 | 10/1975 | Beckerman et al. | 316/20 |
| 4,029,371 | 6/1977 | Kupsky | 316/19 |

*Primary Examiner*—Richard B. Lazarus

*Attorney, Agent, or Firm*—R. J. Steinmeyer; F. L. Mehlhoff; William H. May

[57] ABSTRACT

A process for making the final seal in a gas discharge display using a piece of low temperature glass cane which is melted to form a generally flat seal within an access hole in one of the insulating plates of the display. The generally elongated piece of cane glass is inserted into an access hole in one of the insulating plates and after being exposed to a melting temperature it fills the access hole area in the insulating plate, leaving no protrusions on the outside surface of the display.

2 Claims, 3 Drawing Figures

METHOD OF SEALING GAS DISCHARGE DISPLAYS

BACKGROUND OF THE INVENTION

The present invention relates to gas discharge displays and, more particularly, is related to methods used to form the final seal in the display device after the insertion of the ionizable gas within the sealed envelope of the display.

The most prevalent prior art approach to forming the final seal in a gas discharge display has been the utilization of a pinched off glass tubulation which projects from the outside surface of one of the insulating plates. This tubulation is utilized to facilitate the evacuation of the atmosphere within the envelope followed by the introduction of the ionizable gas through the same tubulation. Once the envelope receives the ionizable gas, the tube is pinched off to seal the display and retain the ionizable gas within the envelope.

Although this procedure has proved successful with respect to proper evacuation and introduction of ionizable gas into the envelope as well as establishment of an adequate seal, the projecting tubulation presents a fragile protuberance from the display which is exposed to possible breakage during the handling of the display. Quite often displays are damaged as the result of the fragile tubulation being broken or cracked when the displays are being moved or packaged for shipment. The tubulation not only presents a more difficult packaging problem to ensure adequate protection of the tubulation, but also occupies more shipping space.

One prior art arrangement shown in the U.S. Pat. No. 3,914,000 issued to Beckerman et al. shows a method of providing a final seal for a display which does not have a projecting tubulation. However, this particular arrangement requires a specially made type of plug and a small heater for placement closely adjacent the plug to properly melt it. This appears to be a very complicated and unnecessarily time consuming arrangement, since it adds an additional step to the overall process of making the gas display including the formulation of the final seal.

In another prior art device shown in U.S. Pat. No. 4,009,407 issued to Kupsky, a piece of elongated glass rod is positioned adjacent an aperture in the sealing perimeter between the insulating plates. However, there is no disclosure as to exactly how the rod is placed adjacent the aperture in this seal perimeter. No attention is directed to how the seal rod is held in its proper place with respect to a hole in the perimeter of the seal during the sealing process. In certain types of gas discharge displays the perimeter seal is quite narrow, and the use of an edge seal of this type may extend into the viewing window too far.

SUMMARY

The present method for sealing a gas discharge display comprises the placement of a piece of low temperature glass cane which is a generally elongated rod within a circularly flared hole in one of the insulating plates in such a manner that one end of the rod is resting within the hole without touching the inside surface of the opposing plate. The display is then placed in an enclosed compartment or furnace wherein the interior envelope is evacuated and the appropriate ionizable gas is inserted within the envelope. After the introduction of the ionizable gas, the temperature is raised in the furnace to cause the low temperature glass cane to melt. Because the surface tension forces in the melting glass tend to form a spherical shape, the glass will form a plug in the tapered aperture of the insulating plate to establish a final seal with no protuberance from the surface of the plate. The present invention eliminates the presence of any tubulation projecting from the display that could be subjected to possible breakage or damage during movement in the production process or in shipment.

The use of an elongated low temperature glass cane which is positioned in a generally upright position within the access hole of the insulating plate ensures the proper retention of the sealing cane in the access hole which is to be sealed after the insertion of the ionizable gas. This method permits the insertion of a plurality of display devices into a vacuum furnace wherein the complete process of evacuating the display envelope, inserting the ionizable gas and melting the low temperature glass cane can be accomplished.

Consequently, this process provides for proper final sealing of the gas display without requiring an additional special heating element to melt the sealing material or require a completely separate step in the process of assembling the display which would increase the time necessary for the overall production of the display. Also, this seal does not affect the size or the width of the perimeter seal of the display.

DETAILED DESCRIPTION OF THE INVENTION

Figure 1:
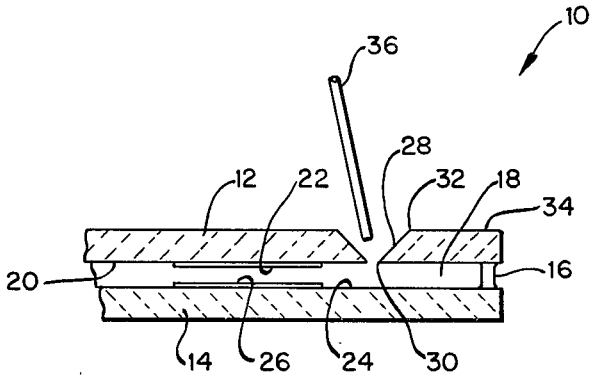
FIG. 1 is a partial sectional view of a gas discharge display with the cane seal of the present invention being inserted within an aperture of the display.

A gas discharge display 10 is partially shown in FIG. 1 having a substrate 12 and a face plate 14 which are sealed together in spaced relation by a sealing material at the periphery 16. The respective substrate 12 and face plate 14 form the sealed envelope 18. Positioned on the inside surface 20 of the substrate 12 is a cathode electrode 22. Located on the inside surface 24 of the face 14 is an anode 26 in operating relation to the cathode 22. It should be noted that the anode 26 could be placed coplanar with the cathode electrode 22.

An access hole 28 is preferably sandblasted into the glass or ceramic substrate 12 to form a tapered hole with the smaller aperture 30 being adjacent the inside surface 20 of the substrate 12. The hole tapers outward with the larger diameter 32 being essentially coplanar with the outside surface 34 of the substrate 12.

Figure 2:
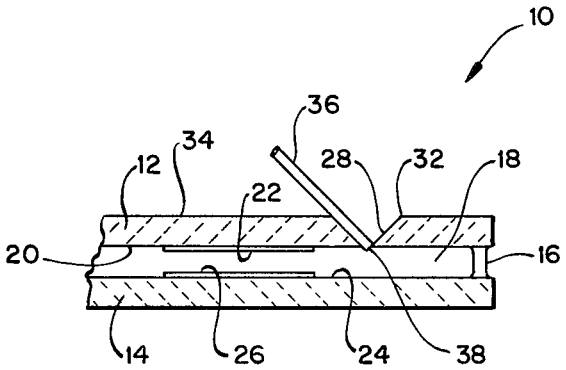
FIG. 2 is a partial sectional view of the gas discharge display with the cane seal in position prior to melting.
Figure 3:
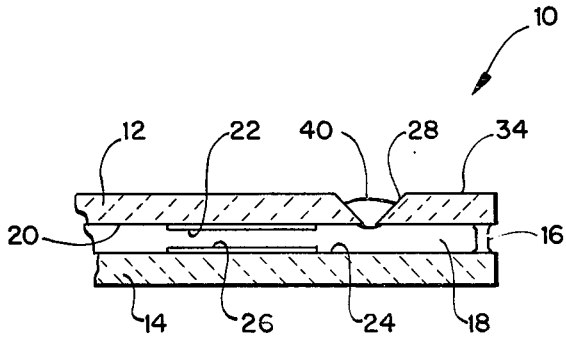
FIG. 3 shows a partial sectional view of the display device with the final seal formed.

A piece of low temperature cane glass rod 36 is designed to lie within the access hole 28 to a position as shown in FIG. 2. The size of the cane glass rod 36 is slightly smaller than the size of the smaller aperture 30 in the access hole 28. This will allow for the evacuation of the atmosphere within the envelope 18 as well as for the introduction of ionizable gas prior to the melting of the cane glass 36 as will be explained herein.

The cane glass rod 36 has a particular thickness with respect to the access hole, so that the end 38 of the glass rod 36 will be held within the access hole as shown in FIG. 2. However, in some instances the end 38 of the rod 36 could be inserted completely through the access hole 28 with the end 38 resting on the inside surface of the face plate 14.

Turning to the method of making an assembly in the gas discharge display 10, reference is made to FIG. 2 wherein the respective cathodes 22 and anodes 26 are placed on the respective inside surfaces 20 and 24 of the substrate 12 and the face plate 14. However, prior to the placement of the electrodes on the respective inside surfaces of the display, the tapered access hole 28 is sandblasted in the substrate 12 with the larger diameter 32 being essentially coplanar with the outside surface 34 of the substrate 12. The substrate 12 and face plate 14 are joined together by the glass seal 16 which extends around the perimeter of the respective substrate 12 and face plate 14 to form the enclosed envelope 18. Included in the glass seal 16 are spacer means to provide the proper spacing between the substrate 12 and the face plate 14.

The cane glass rod 36 is inserted into the access hole 28 and rests against the side of the hole. In some cases, one end 38 of the cane glass 36 may rest on the inside surface 24 of the face plate 14. The display device 10 is then inserted into a vacuum furnace where the envelope 18 is evacuated through the access hole 28. The envelope is then filled with the ionizable gas such as neon or argon through the access hole 28. This is typically done at 350° C. at 100–300 torr. The temperature is then raised to approximately the range of 470° C. to 500° C. and held for approximately 20 to 30 minutes to provide melting of the cane glass 36. Surface tension forces of the cane glass tend to form a spherical shape blocking the access hole as the glass cane melts and wets the hole. This seal partially fills the tapered access hole 28 and leaves no projecting part extending from the outside surface 34 of the base plate 12. The substrate 12 and the face plate 14 are typically made of glass which has a considerably higher melting temperature than the cane glass rod. Therefore, the melting of the cane glass rod will not affect the integrity of the substrate and face plate, or the face plate/substrate seal area.

By way of example of the access hole at its narrowest dimension would be 0.06 inches while the larger dimension 32 would be 0.2 inches. As stated previously, the preferred method of making the access hole 28 is sandblasting which will form the desired tapered hole. In the alternative, the hole could be drilled to its tapered shape.

After the heating of the cane material to form the plug seal 40 the display devices are allowed to cool to approximately room temperature within the furnace prior to removal from the furnace.

Preferably the type of glass used for the cane seal is No. 1417 of Corning Glass Works. Preferably size is 0.050 inches. The preferable length is 0.125 inches.

In an alternate approach, the cylindrical cane glass rod could be eliminated completely and be replaced by a somewhat spherical or tear-shaped glass piece. This alternate piece of spherical or tear-shaped glass would not be made perfectly symmetrical so that a slight gap would be established between the glass piece and the hole to allow for the passage of air and the ionizable gas.

What is claimed is:

1. A method of making a final seal for a plurality of gas discharge display devices at one time, each of said devices having two insulating plates sealed together in spaced relation to form an enclosed envelope with a plurality of electrodes on at least one of said plates to establish an electrical field for glow discharge of an ionizable gas within said envelope, said method comprising:

making a conical access hole completely through one of said plates of each of said devices;

laying on the side of each of said holes an upright elongated solid rod of low temperature melting point glass within each of said access holes, the cross-sectional area of said rod being smaller than the size of said conical access hole at its smallest end so that a gap is formed between said rod and said hole when said rod is in said hole;

moving said plurality of devices with said rods of glass into a vacuum furnace at one time;

simultaneously evacuating the air from within each of said envelopes through said gap between each of said access holes and said glass rod;

simultaneously introducing said ionizable gas into each of said envelopes through said gap in each of said access holes; and raising the temperature of said vacuum furnace to a point below the melting point of said plates of said devices and above the melting point of said glass rods to simultaneously melt said plurality of glass rods within said access holes to fill and seal said holes.

2. A method of making the final seal for a plurality of gas discharge display devices at one time, each of said devices having two insulating plates sealed together in spaced relation to form an envelope containing ionizable gas and electrode means for igniting said gas to produce a visible glow discharge, said method comprising the steps of:

making a conical access hole completely through one of said plates of each of said devices;

mounting said electrode means on said one of said plates of each of said devices;

sealing said two plates together for each of said devices to establish each of said envelopes;

inserting an elongated piece of cane glass upright within each of said access holes, said piece of cane glass having a smaller cross-sectional size than the size of said hole;

placing said plurality of said devices within a vacuum furnace;

resting one end of said piece of cane glass on the interior surface of the other of said plates;

simultaneously evacuating the air from within each of said envelopes through that portion of said access hole not occupied by said piece of cane glass;

simultaneously introducing said ionizable gas into said envelopes through said access holes;

simultaneously melting said pieces of cane glass by raising the temperature within said vacuum furnace; and simultaneously transforming said elongated pieces of cane glass into partial spherical shapes within said access holes to seal said access holes of said devices at one time.

* * * * *